United States Patent [19]

Haour et al.

[11] Patent Number: 4,559,187

[45] Date of Patent: Dec. 17, 1985

[54] PRODUCTION OF PARTICULATE OR POWDERED METALS AND ALLOYS

[75] Inventors: Georges Haour, Geneva; Dag Richter, Carouge; Willy Wagnieres, Lancy, all of Switzerland

[73] Assignee: Battelle Development Corporation, Columbus, Ohio

[21] Appl. No.: 561,363

[22] Filed: Dec. 14, 1983

[51] Int. Cl.[4] ..... B22D 23/08

[52] U.S. Cl. ..... 264/11; 264/13; 264/14; 425/6; 425/7; 75/0.5 C

[58] Field of Search ..... 75/0.5 C; 264/11, 13, 264/14; 425/6, 7

[56] References Cited

U.S. PATENT DOCUMENTS

| | | | |
|---|---|---|---|
| 721,293 | 2/1903 | Fuchs | 75/0.5 C |
| 1,886,285 | 11/1932 | Martin | 264/11 |
| 2,304,130 | 12/1942 | Truthe | 264/8 |
| 3,430,680 | 3/1969 | Leghorn | 264/166 |
| 3,813,196 | 5/1974 | Backstrom et al. | 425/7 |
| 4,023,985 | 3/1977 | Dunkerley et al. | 75/0.5 C |
| 4,347,199 | 8/1982 | Speier et al. | 264/8 |
| 4,382,903 | 5/1983 | Larsson et al. | 264/13 |
| 4,386,896 | 6/1983 | Ray | 425/7 |

FOREIGN PATENT DOCUMENTS 2280466 12/1973 France .

*Primary Examiner*—Wayland Stallard
*Attorney, Agent, or Firm*—Barry S. Bissell

[57] ABSTRACT

A free flowing stream of molten metal is motioned to encounter a higher diameter and faster moving free flowing stream of a cooling liquid, such encounter resulting in the splitting of the molten metal into droplets. The droplets in contact with the cooling liquid and entrained therewith are allowed to solidify by cooling; optionally they may undergo further splitting before complete solidification by impingement upon a target arranged to intercept the course of the cooling stream.

10 Claims, 3 Drawing Figures

FIG. 1
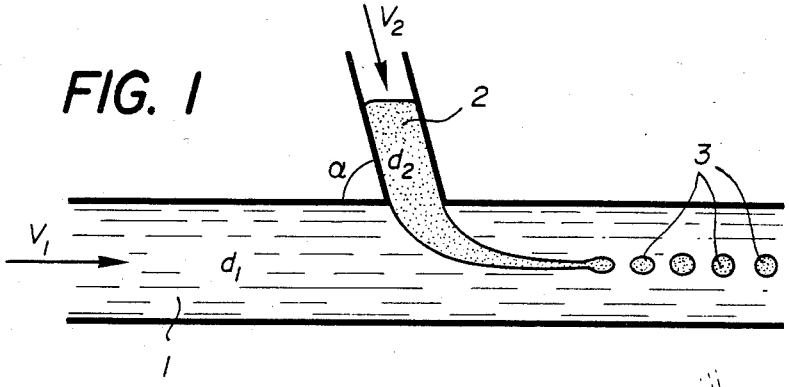
FIG. 2
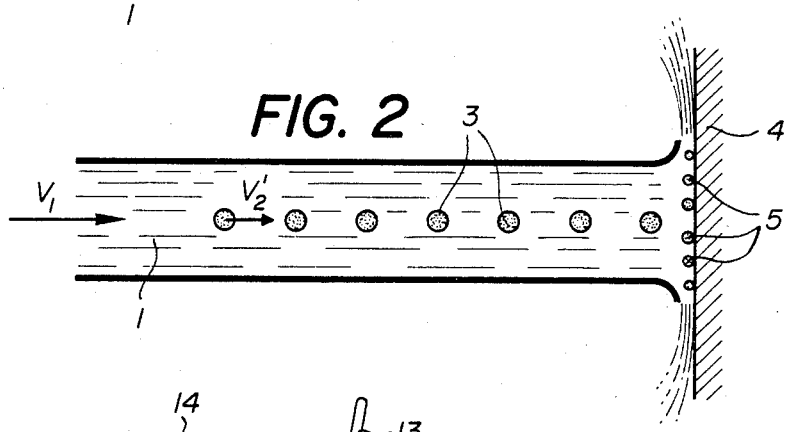
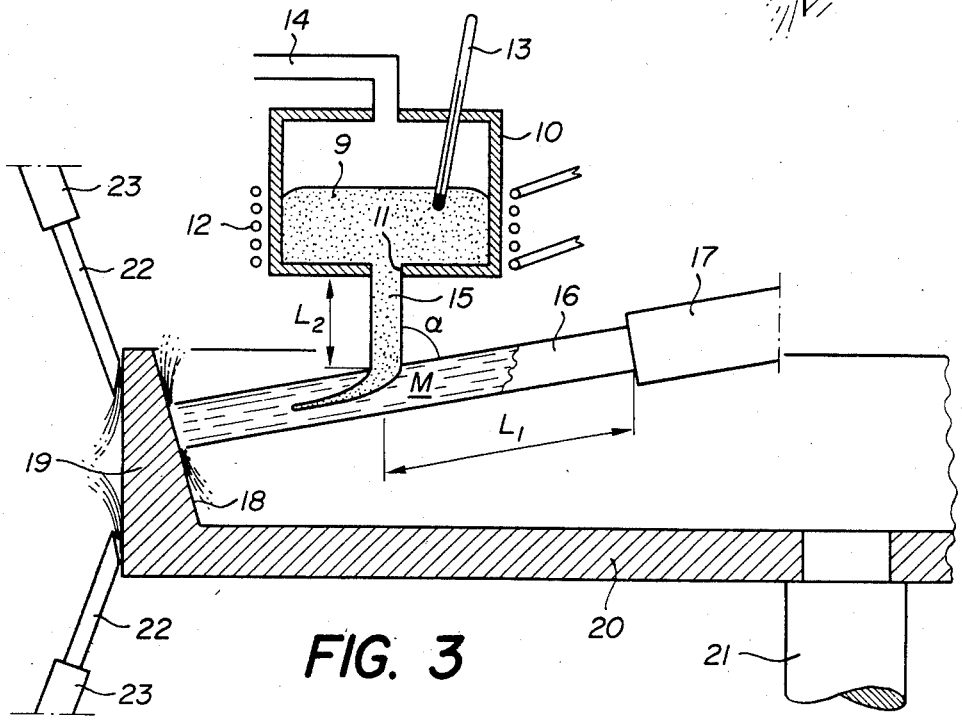
FIG. 3

PRODUCTION OF PARTICULATE OR POWDERED METALS AND ALLOYS

The present invention relates to a method for the production of particulate metals and alloys (powders) in which a stream of molten metal or alloy penetrates into a stream of cooling liquid whereby droplets of molten metal are formed by the action of said cooling stream upon said molten metal stream. Another object of the invention is a device for implementing said method.

In the prior art, Swiss Pat. No. 206,995 discloses a method for the manufacture of metal powders according to which one projects a stream of molten metal on the surface of a rotating disk; the metal droplets resulting from the impact of the liquid on the disk are cooled and solidifed by means of a stream of cooling gas or liquid directed to a point very close to the zone of impact. In this method the disk is used to fractionate the molten metal under the effect of the centrifugal force, into minute droplets. The cooling fluid is used to cool the disk and the molten metal particles until they have completely solidified. Further, the liquid enables one to damp the impact of the droplets against objects possibly located outside the disk.

U.S. Pat. No. 2,304,130 also discloses a method for manufacturing a metal powder in which a molten metal stream and a cooling liquid stream are thrown to a point on a rotating disk. As before, particles are formed under the effect of the centrifugal force at the contact point on the disk and the cooling liquid acts to rapidly solidify the metal particles and to prevent premature aglomeration thereof.

European application No. 81810254.3, entitled "Preparation of Rapidly Solidified Particulates", describes a process for manufacturing fine metal particles by contacting a molten stream of material, which is at a temperature 25 percent of its equilibrum melting point, with a rapidly moving wall of a centrifugally disposed rotating liquid quench fluid, e.g. water or oil, in a manner to disrupt the stream with breaking of the stream into molten globules or particles and to quench rapidly these globules or particles into solid particles.

In the three aforementioned prior art methods, the metal particles are formed by the mechanical action of a rotating disk. The function of the liquid or the gas is only to cool the metal drops and not to participate in the formation of said drops.

U.S. Pat. No. 4,347,199 discloses a process for producing metal powders by means of a rotating disk whose surface is covered with a film of liquid. In this process, one throws a molten metal stream on the disk with enough force for the metal to penetrate into the liquid. Then, due to the centrifugal force, the molten metal is decomposed into particles which are thereafter cooled and solidified by the liquid. Peripheral baffles are arranged on the disk to modify the shape of the particles without changing their size.

Japanese patent application No. 58 067805 discloses a method in which the driving procedures are similar to that prevailing in U.S. Pat. No. 4,347,199; however, in this case the disk is only partly covered with a liquid. These two documents disclose methods in which droplets of molten metal are formed upon impingement of a gush of liquid metal on a rotating surface together with a cooling fluid which serves to cool the metal droplets after they have formed by virtue of the centrifugal force.

U.S. Pat. No. 4,382,903 discloses a method for making metal powders by using spraying means in which gaseous jets, of which one has a velocity of nearly the speed of sound, interact with a molten metal current. The effect of the gaseous jets causes the molten metal to divide into particles and to drive the latter into a cooling area where they will solidify while preventing them from agglomerating near the opening of the nozzle that expells the gas at sound velocity. In this method, the spraying action for the liquid metal is due to the kinetic energy released from the high speed gas stream.

In U.S. Pat. No. 3,430,680, there is disclosed a method for manufacturing metal beads in which a first stream of a molten metal is surrounded by a second stream of a cooling fluid thus providing a liquid sheath around the first stream. By applying mechanical vibration of a determined frequency to the metal stream, the latter is fractionated into metal drops of uniform sizes.

Although the aforementioned methods of the prior art have merit, it has been noted that the cooling means used do not provide a cooling rate sufficient to avoid the occasional formation of defective particles. Further the sizes of the obtained particles are often not sufficiently uniform for some uses.

It is therefore an object of the present invention to provide a method which can remedy the above difficulties by allowing faster cooling rates. In this method, one forms two freely flowing streams, a first stream of a cooling liquid and a second stream of a molten metal or alloy; the motional speed of the cooling stream is not inferior to that of the metal stream and the cross-sectional diameter of the cooling stream is greater than that of the metal stream to the extent that when the streams are coplanar and intersect each other, the metal stream is entirely surrounded by the cooling stream. One directs the two streams toward one another so that they intersect and interpenetrate each other. This interaction results in a perturbation in the flowing mode of the metal stream, such perturbation causing the metal to divide into droplets of substantially akin size, said droplets remaining in contact with the cooling liquid until they have solidified into metal particles.

Another object of the invention is a device or apparatus for carrying out the above-mentioned method. This device comprises means for providing a first stream of a cooling liquid and a second stream of a molten metal or alloy, means to heat and melt such metal or alloy and maintaining it at or above the melting temperature, means for leading the two streams toward each other so that they encounter and interpenetrate in a manner such that the molten metal of the second stream is fractionated into droplets such droplets being retained in the first stream until they solidify.

The invention will now be described in more detail with the help of the accompanying drawing in which:

FIG. 1 is a schematic cross-sectional side representation of a detail of an apparatus for fractionating a liquid metal into particles showing the principles of its operation.

FIG. 2 is a schematic representation of another detail (optional) of such apparatus.

FIG. 3 is a schematic side view of an apparatus for carrying out the method of the invention.

FIG. 1 represents a first stream 1 of diameter $d_1$ of a cooling liquid moving with velocity $V_1$ and a second stream 2 of cross-sectional diameter or crossection $d_2$ of a molten metal moving at velocity $V_2$ and intersecting with stream 1 under an angle $\alpha$. Velocity $V_1$ being greater than $V_2$, the flow of stream 2 after entering into stream 1 is modified as shown schematically in the drawing. There, the metal flow undergoes a so called stretching action which results in its division into droplets 3. In other words, the liquid metal is entrained by the flow of moving cooling liquid and, in doing so, it undergoes a velocity increase with consecutive diameter reduction which results in its fractionation into minute droplets of substantially uniform size. This phenomenon is not new per se as it conforms to the laws of Rayleigh pertaining to continuous liquid flow condition and according to which when a perburbation is applied to a jet of liquid, the latter is fractionated into a plurality of droplets of substantially uniform size. The size of said droplets depends on the diameter of the metal flow after stretching in the first stream, i.e. the smaller this diameter, the smaller are the droplets. Therefore, for obtaining droplets of a size much smaller than the cross-section of the metal stream 2, the velocity $V_1$ of stream 1 must be sufficiently greater than $V_2$ to provide a strong reduction of the diameter of the metal stream under the stretching effect of stream 1 before it starts fractionating as a consequence of the perturbation from the interaction of the two streams.

It becomes obvious from the present description that uniformly sized metal droplets can only be produced when the total of the molten metal of stream 2 is embedded or wrapped in stream 2 so that the molten metal is entirely surrounded by the cooling liquid. For achieving such conditions, diameter $d_1$ of stream 1 must exceed that of stream 2. Also $V_1$ and $V_2$ relative to each other must be selected under such limits that the difference between them is not so great as to cause the molten metal to bounce upon impingement on the cooling liquid. Also $V_2$ must not be so great relative to $V_1$ as to cause the metal stream 2 to be driven across stream 1, i.e. to get through it from side to side whereby part of the molten metal would escape entrainment by the cooling liquid. Such a condition might exist when $V_1$ is too low of if $V_2$ is too high. The angle $\alpha$ is preferably comprised between a non-zero value say about 10°, and 90°. Too low an angle would introduce constructional difficulties and values above 90° could cause rebouncing.

The optional modification of the apparatus represented on FIG. 2 comprises a target 4 constituted by a solid surface (metal or other inert material) of a material object which is placed to interrupt the linear displacement of stream 1 containing the droplets 3. When said droplets, still in the liquid state (or viscous state if solidification by cooling has already commenced), hit the target they may be further fractionated into smaller particles 5. In addition, the effect of the target is also to introduce violent turbulence in the liquid fluxes and to amplify the cooling rate of the metal particles by disrupting the gaseous envelope of vapor which surrounds them from initial evaporation of the cooling liquid. Preferably, the target is flat or has a relatively low curvature and it is preferably placed somewhat slantwise relative to the impinging jet stream so that the suddenly stopped liquid can collect evenly on one preferred side and not splash irregularly on all sides around the point of impact. It is also important that the comminuted droplets be cooled and solidify as instantly as possible after the shock; therefore cooling means (not represented on the drawing) can be incorporated to the object whose surface constitutes the target 4. In one variant, the target is the inside surface of a hollow part having a frusto conical shape. In such case, this frustum can be rotated so as to continuously renew the target impact area to reduce contact time between molten metal and target and improve cooling.

The device shown schematically on FIG. 3 comprises a storage tank 10 made of a refractory material, e.g. MgO or graphite and constituting the source of a metal or alloy 9 to be converted to metal particles. The metal is heated and melted by heating means 12 (represented here as an inductive heating coil but being possibly a different usual heating means). The tank 10 also comprises an opening 11 whereby the molten metal 9 is formed into a free flowing steady stream 15 of molten metal directed downwards in this particular embodiment. Obviously, this downward direction results from a selection pertaining to the form of embodiment detailed here and should not be considered as limitative, other directions suiting other types of embodiments being also possible. The storage tank 10 also comprises a duct 14 for supplying an inert gas (from a non represented source) under pressure, this pressure being intended to control the flow parameters of stream 15 depending on the viscosity of the molten metal used and its temperature as recording by the temperature measuring probe 13.

The apparatus represented further comprises an adjustable nozzle 17 connected to a hose and a pump (not represented) for providing a cooling liquid formed into a stream 16 directed toward stream 15 and whose axis of motion is coplanar with that of stream 15. Because of this complanarity of the axis of displacement, both streams meet at a point of space M under an angle $\alpha$. This angle, as well as the distances $L_1$ and $L_2$ between the point M and the nozzle 17 or the tank 10, respectively can be modified if desired by changing the position and the orientation of the nozzle 17 although keeping the streams coplanar. The diameter of the stream 16 and its velocity are controlled by nozzle 17 to be significantly greater than the diameter of stream 15 and the velocity of the latter, respectively.

The present device can further optionally comprise a target 18 constituted by the inner surface of a hollow frustum shaped cylinder 19 coaxially integral with a circular plate 20 installed for rotation on an axle 21. Thus, the target can be rotated horizontally by means of a driving motor (not represented) acting on axle 21. The target surface can be cooled by means of water jets 22 provided by sparging nozzles 23 acting on the back side of the frustoconical cylinder 19.

When under operation, the present apparatus functions as follows: the metal of tank 10 is heated to the proper melting temperature (or above) and, once molten, the liquid metal is driven through opening 11 whereby a steady stream 15 of molten metal is formed and moved toward stream 16 at a velocity $V_2$. A cooling liquid which can be water, oil or any machine cooling fluid (e.g. organic liquids) is brought under pressure and squirted though nozzle 17 with the proper cross-sectional size $d_1$ and velocity $V_1$ to meet the above disclosed requirements. The two flows of liquid meet at point M whereby the liquid metal undergoes a perturbation and is fractionated into droplets of substantially homogeneous size and shape according to the mechanism already described. At this stage, said droplets can be allowed to simply solidify while under entrainment by the cooling liquid after which they will be collected as such (together with the liquid of stream 16) by usual collection means (unrepresented) or, according to the aforedisclosed variant, the cooling stream 16 carrying the still unsolidified droplets can be caused to hit target 18. Due to the sudden interruption of the steady flow, turbulences will be induced within the cooling liquid and cause accelerated cooling of the particles. Also, due to the resulting shock on the target, the droplets may undergo further comminution into smaller droplets. For temperature control, the target is cooled by the water sprinkled from nozzles 23. Then the liquid of broken stream 16 containing the solidified particles of reduced size will overflow, after deflection by the target, as shown on FIG. 3 and will be collected by usual means. The metal powder can thereafter be separated by decantation and dried as usual in air or in an oven. It can be seen from the aforementioned description that the present apparatus can operate in a continuous fashion which is a further advantage relative to the devices of the prior art.

The following Examples in which water is used as the cooling liquid of streams 1, 16 illustrate the invention in more detail.

EXAMPLE 1

Using the apparatus disclosed with reference to FIG. 3, an aluminum powder containing 5% of Cu was prepared starting from 54.6 g of crude metal. In this Example, the target 18 was omitted and the particles resulting from the fractionation of the molten metal after interpenetration of the two streams 1.15 and 2.16 at point M were collected directly. The yield was 60% relative to the initial metal weight of a powder of sub-mm size. 51% by weight of the particles were between 0.5 and 1 mm and 31% between 0.25 and 0.5 mm; the remaining ones were smaller. The operational parameters are gathered in Table I hereinafter.

EXAMPLE 2

Forty five g of the alloy of Example 1 were converted into a metal powder using the same technique but involving use of the target 18. Operational parameters are listed in Table I. In this case, the yield of conversion into a sub-mm size powder was 85%, 40% by weight of the obtained particles exceeding 0.5 mm.

EXAMPLE 3

A conversion similar to that of the previous Example was carried out on 133 g of copper. The operational parameters are listed in Table I. The overall yield was 96% of a copper powder whose particles were below 0.25 mm. The particles of 40% of this powder had a size below 80 μm.

EXAMPLE 4

An alloy containing by weight 1 part of Al for 1 part of Cu was converted into a powder with an overall yield of 98% by the technique of the previous Examples including the use of the target 18. Among the particles of sub-mm size, 40% were below 0.5 mm. The operational parameters are shown in Table I. Parameter $T_m$ is the difference between the melting temperature of the alloy under consideration and the temperature measured by probe 13.

TABLE I

| Ex no. | $d_2$ (mm) | $V_2$ (m/sec) | $d_1$ (mm) | $V_1$ (m/sec) | $T_m$ (°C.) | α (°) | $L_2$ (mm) | $L_1$ (mm) |
|---|---|---|---|---|---|---|---|---|
| 1 | 1 | 3.5 | 5.5 | 28 | 50 | 45 | 70 | 15 |
| 2 | 1 | 2.5 | 4.5 | 29 | 150 | 70 | 70 | 15 |

TABLE I-continued

| Ex no. | $d_2$ (mm) | $V_2$ (m/sec) | $d_1$ (mm) | $V_1$ (m/sec) | $T_m$ (°C.) | α (°) | $L_2$ (mm) | $L_1$ (mm) |
|---|---|---|---|---|---|---|---|---|
| 3 | 0.5 | 1 | 4.5 | 29 | 110 | 70 | 50 | 8 |
| 4 | 0.5 | 5.5 | 4.5 | 29 | 50 | 70 | 60 | 15 |

In addition to the data provided in the above Table (data representing optimized parameters with regard to the results sought after), the following general remarks can be made.

Increasing the speed $V_1$ of stream 16 or decreasing the diameter of stream 15 enables to reduce the size of the metal particles.

Increasing diameter $d_1$ of stream 16 has not detectable influence on the particle size. However, using relatively wide streams 16 is an advantage since the effective incorporation therein, during interpenetration of stream 15 is facilitated when the difference $d_2-d_1$ is relatively large.

Decreasing diameter $d_2$ of stream 15 enables to increase the relative proportion of fine particles in the powder. However, too small cross-sectional diameters for stream 15 may cause difficulties in obtaining correct displacement speeds $V_2$ for ensuring sufficient interpenetration of metal and cooling liquid.

A correct choice of parameters $V_1$ and $V_2$ coupled with the cross-sectional diameter of stream 15 is fundamental. Thus, for instance, starting with a cooling stream 16 whose parameters were $d_1=5.5$ mm and $V_1=28$ m/sec, if the velocity of the metal stream $V_2$ was below 1 m/sec, the liquid bounced back upon encountering the cooling liquid; in contrast, if the velocity $V_2$ was in excess of 5 m/sec, the metal jet was unstopped and went entirely across the stream of cooling liquid.

The parameter $T_m$ which defines the value of temperature of the molten metal above its melting point is important to the extent that it should be sufficient to ensure that the metal droplets are still in a plastic (deformable) state to undergo further division when hitting the target. Otherwise, the $T_m$ value has no influence on the obtained powder quality.

The value of the angle α does not relate to the size of the particles. However α should not exceed 90° for avoiding bouncing back of the liquid metal; further, for angles below 90° the penetration of the liquid metal into the cooling liquid is improved.

The geometrical shape of the target or its rotational velocity do not appear to influence the quality of the metal powders; however, it is preferable that the rotation be fast enough to enable the liquid (plus the particles) to be expelled over the edges of the hollow frustum under the action of the centrifugal force. For instance, if an opened frustum with a taper of 20° is used, a rotation velocity of 2000 rpm is satisfactory.

The distance between the intermingling point M and the target should not exceed a certain value over which the metal droplets resulting from the interaction of the two liquids would have completely solidified, this being for enabling the still unsolidified particles to be further split upon hitting the target. With a temperature difference $T_m$ larger than 25° C., values for this distance of from 1 to 20 cm were found satisfactory.

Using water at room temperature as the cooling liquid enables to obtain cooling rates for sub-mm size droplets in the order of more than $10^3$ degrees/second.

We claim:

1. Method for production of metal or alloy powder wherein a liquid coolant stream intercepts and fractionates a molten metal or alloy stream into molten droplets, the improvement comprising causing the liquid coolant stream to intercept the metal or alloy stream with such higher volume and velocity that the molten droplets are entrained in the coolant stream and entirely surrounded thereby until the molten droplets completely solidify or until the molten droplets are further reduced by impacting a target.

2. The method of claim 1 wherein the velocity of the liquid coolant is between about 4 and 50 times the velocity of the metal or alloy stream, the temperature of the molten metal or alloy is at least 10° C. above the melting point of said metal or alloy, the temperature of the liquid coolant stream is substantially ambient temperature and the angle between the paths of the two streams under impact does not exceed 90°.

3. Method according to claim 1, wherein the value of $V_1$ is at least 14 m/sec and from 4 fold to 50 fold the value of $V_2$, the temperature of the molten metal or alloy is at least 10° C. above the melting point of said metal or alloy, the temperature of the cooling liquid is substantially close to ambient temperature and the angle between the paths of the two streams under impact does not exceed 90°.

4. Method according to claim 1, which comprises directing the liquid coolant stream and molten droplets onto a target which intercepts said liquid coolant stream and imparts to the liquid a turbulent motion thus causing a sudden increase of the rate of cooling of said molten droplets.

5. Method according to claim 4, which comprises cooling the target to a temperature close to that of room temperature.

6. Device for producing metal or alloy in particulate or powdered form comprising (a) means to heat a metal or alloy to the molten state and maintaining it at the melting temperature or at a temperature higher than the melting temperature;

(b) means for providing a first stream (1) of a free flowing cooling liquid and a second stream (2) of a free flowing molten metal or alloy said means being adaptable for controlling the cross-sectional area and the velocity of both streams;

(c) means for directing the motion of the two streams toward each other and causing said streams to interpenetrate and interact at a point M of space so that the molten metal stream is fractionated into molten metal droplets and said metal droplets are entrained in the cooling liquid and entirely surrounded thereby until they solidify or until they are further reduced by impacting a target.

7. Device according to claim 6, further comprising target means arranged to intercept said first stream downstream from point M of interpenetration of the two streams at a distance close enough to that point for said droplets to be in a still unsolidified deformable state, the shock of said droplets against said target means causing them to further split into smaller particles.

8. Device according to claim 7, wherein the target means are constituted by a surface of a solid oriented slantwise relative to the direction of motion of the cooling fluid.

9. Device according to claim 8, wherein the target is the inner surface of an overturned hollow cylindrical frustum made coaxially integral by its smaller base with a rotatingly arranged circular base plate.

10. Device according to claim 9, wherein the target includes cooling means for maintaining said target at a temperature near to ambient temperature.

* * * * *